US006068311A

United States Patent [19]

Jones

[11] Patent Number: 6,068,311

[45] Date of Patent: May 30, 2000

[54] SANITARY PICKUP DEVICE

[76] Inventor: Galen K. Jones, 23707 Wildwood Canyon Rd., Newhall, Calif. 91321

[21] Appl. No.: 09/304,512

[22] Filed: May 3, 1999

Related U.S. Application Data

[60] Provisional application No. 60/084,082, May 4, 1998.

[51] Int. Cl.[7] ..... A01K 29/00; E01H 1/12

[52] U.S. Cl. ..... 294/1.4; 294/19.1

[58] Field of Search ..... 294/1.3–1.5, 11, 294/19.1, 22, 50.8, 50.9, 103.1, 104, 115; 15/257.4–257.7; 119/161

[56] References Cited

U.S. PATENT DOCUMENTS

| | | | |
|---|---|---|---|
| 2,790,437 | 4/1957 | Moore | 294/19.1 X |
| 3,446,525 | 5/1969 | Jones | 294/1.4 |
| 4,225,174 | 9/1980 | Hennessy et al. | 294/1.4 |
| 4,231,603 | 11/1980 | van Zelm | 294/19.1 |
| 5,174,300 | 12/1992 | Bales et al. | 294/19.1 X |

FOREIGN PATENT DOCUMENTS

| | | | |
|---|---|---|---|
| 632621 | 11/1949 | United Kingdom | 294/19.1 |
| 739209 | 10/1955 | United Kingdom | 294/19.1 |

*Primary Examiner*—Johnny D. Cherry
*Attorney, Agent, or Firm*—Roger A. Marrs

[57] ABSTRACT

A sanitary, portable pickup-and transporting device for unclean material such as animal droppings and which permits the user to collect the material in a disposable bag supported on the pickup device for ready removal and replacement by a fresh bag. The pickup device includes an elongated body having a handle at one end and a pickup arrangement at its other end. The pickup arrangement includes a pair of bails wherein a stationary bail is fixed to a yoke member carried on the end of the body and a movable bail is movable with respect to the body and is also carried on the yoke member. An actuating mechanism is carried on the body and includes an elongated rod having a lever mechanism carried on one end adjacent to the handle and having an offset connection carried on the other end of the rod forming apart of the movable bail. A resilient device is provided for returning the movable bail to a position immediately adjacent to the fixed or stationary bail.

4 Claims, 2 Drawing Sheets

2
2
26
11
27
25
28
12
24
23
11
22
35
34
10
32
33
13
31
14
30
15
21
18
17
19
16
20
21
40
23
11
31
30
15
14
17
40
19
11
23
30
31
21
17
14
15
19
40
13
21
40
66
70
73
52
60
53
66
71
60
52
53
70

50
51
52
53
54
55
56
57
58
60
61
62
63
64
65
66
67
8
9A

SANITARY PICKUP DEVICE

This application claims the benefit of U.S. Provisional patent application Ser. No. 60/084,082 filed May 4, 1998.

BACKGROUND OF THE INVENTION

1. Field of the Invention

The present invention relates to the field of sanitary pickup devices for animal droppings and the like and more particularly to a novel portable pickup device having an improved litter or dropping pickup bail and actuator arrangement for positive grasping and collection of material to be picked up and disposed of.

2. Brief Description of the Prior Art

It is often desirable to have a clean, sanitary device for picking up unclean material such as droppings from dogs, cats, etc., for transporting the material to a convenient disposal place, such as a garbage can, and for depositing the material in the can.

In addition to the desirability of keeping lawns, parkways, walks and the like clean of such material which may present a health hazard, there may be laws or ordinances requiring the owner of an animal to perform such cleanup or there may be such requirements in leases or in condominium agreements.

It is particularly desirable to be able to accomplish such cleanup in a sanitary manner without contaminating or getting such material on the user's hands or clothing, or on the permanent parts of the pickup device.

Prior devices generally involved pushing or scraping the material into some permanent container or receptacle, such as a pan or cup, either with an additional tool or by scooping the material with the receptacle itself. This invariably resulted in the receptacle and/or the tool becoming contaminated by the material and requiring that it be cleaned immediately to avoid an unsanitary condition created by merely storing the device.

Further, prior devices generally required the user to bend down to ground level, which is inconvenient and uncomfortable, particularly for older people, people with back problems, etc. In addition, prior devices required great care in transporting the material to avoid dropping it, and often they would not readily permit picking up a second load of material without first being unloaded.

The conventional devices permit the user to grasp the material in a disposable wrapper means supported on the device for ready removal and replacement by a fresh wrapper means. The wrapper may be baglike wherein an inverted bag can be placed between open frame pickup members and the marginal portions of the bag turned over the bottom edges of the members so that when the members are then moved together about a body of material to be collected, the material is retained in sealed condition within the bag and does not touch the members or other parts of the device. The bag being of compliant material may thereby extend outwardly through the open frame members. The members may again be moved apart to release the collected material, and the disposable wrapper may also be removed from the device without touching the portion which contacted the unclean material.

Although a multiplicity of sanitary pickup devices have been employed in the past, a typical example is disclosed in U.S. Letters Patent 3,446,525. However, problems and difficulties have been encountered which stem largely from the fact that the bail and actuator mechanism do not always permit achievement of the above-mentioned goals and intended usage. For example, the device described in U.S. Pat. No. 3,446,525 includes a pair of moving bails which are opened into a wide condition by means of a scissors or an overcenter toggle mechanism so that a wide entrance is provided between the bails for reception of droppings into a bag that has been preloaded onto the bail arrangement. Such a mechanism is complex requiring internal spring-loaded construction as well as a mechanical linkage interconnecting a hand-operated lever with the pair of movable bails. Because the bails are both movable, positive reception and pickup of droppings is not always obtainable. Also, maintenance of the pickup bag on the pair of bails is less secure when both bails are movable. Likewise, when it is time to discard a loaded bag, the pair of movable bails is more awkward and less convenient to operate during the disposal and discarding procedure. In order to provide for more effective release of the bag and disposal of its contents, a single movable bail has been found to be more effective.

Therefore, a long-standing need has existed to provide a novel sanitary pickup device for animal droppings or the like which has an improved bail pickup means and mechanism which not only enhances the pickup process but provides for a more convenient disposal procedure.

SUMMARY OF THE INVENTION

Accordingly, the above problems and difficulties are avoided by the present invention which provides a convenient sanitary and portable pickup and transporting device for unclean material such as animal droppings or the like, and which permits the user to collect the material in a disposable bag means supported on the pickup device for ready removal and replacement by a fresh bag means. In a preferred form, the portable pickup device includes an elongated body having a handle at one end and a bail pickup arrangement at its other end. The bail arrangement includes a pair of bails wherein a first bail is fixed to a yoke member carried on the end of the body and a second bail which is movable with respect to the body and which is also carried on the yoke member. An actuating mechanism is carried on the body and includes an elongated rod having a lever mechanism carried on one end adjacent to the handle and having an offset connection means carried on the other end of the rod forming a part of the movable bail. Therefore, by actuating the lever mechanism in combination with the handle, the movable bail can be moved towards and away from the fixed bail carried on the yoke. A resilient means is connected between the body and the elongated rod of the actuating mechanism for returning the movable bail to a position immediately adjacent to the fixed or stationary bail. A bag of compliant material may be inverted and placed over the pair of bails preparatory for pickup of unsanitary matter or the like.

Therefore, it is among the primary objects of the present invention to provide a novel sanitary pickup device which includes an elongated body member having a handle at one end and a pair of bails at the opposite end of which one bail is stationary and the other bail is movable with respect thereto by means of an actuating mechanism.

Another object of the present invention is to provide a novel sanitary pickup device which utilizes separate and replaceable disposable wrapper means, such as a compliant bag-like means that may be readily detachable from the pair of bails by opening of one bail with respect to another to release the grip for permitting a loaded bag to fall free and clean.

Still a further object of the present invention is to provide a novel sanitary pickup device for animal droppings which is simple and economical to manufacture and may utilize inexpensive compliant materials for the disposable wrapper means.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the follow description, taken in connection with the accompanying drawings in which:

DESCRIPTION OF THE PREFERRED EMBODIMENT

Figures 1, 2, 3, 4, 5, 10A, 10B:
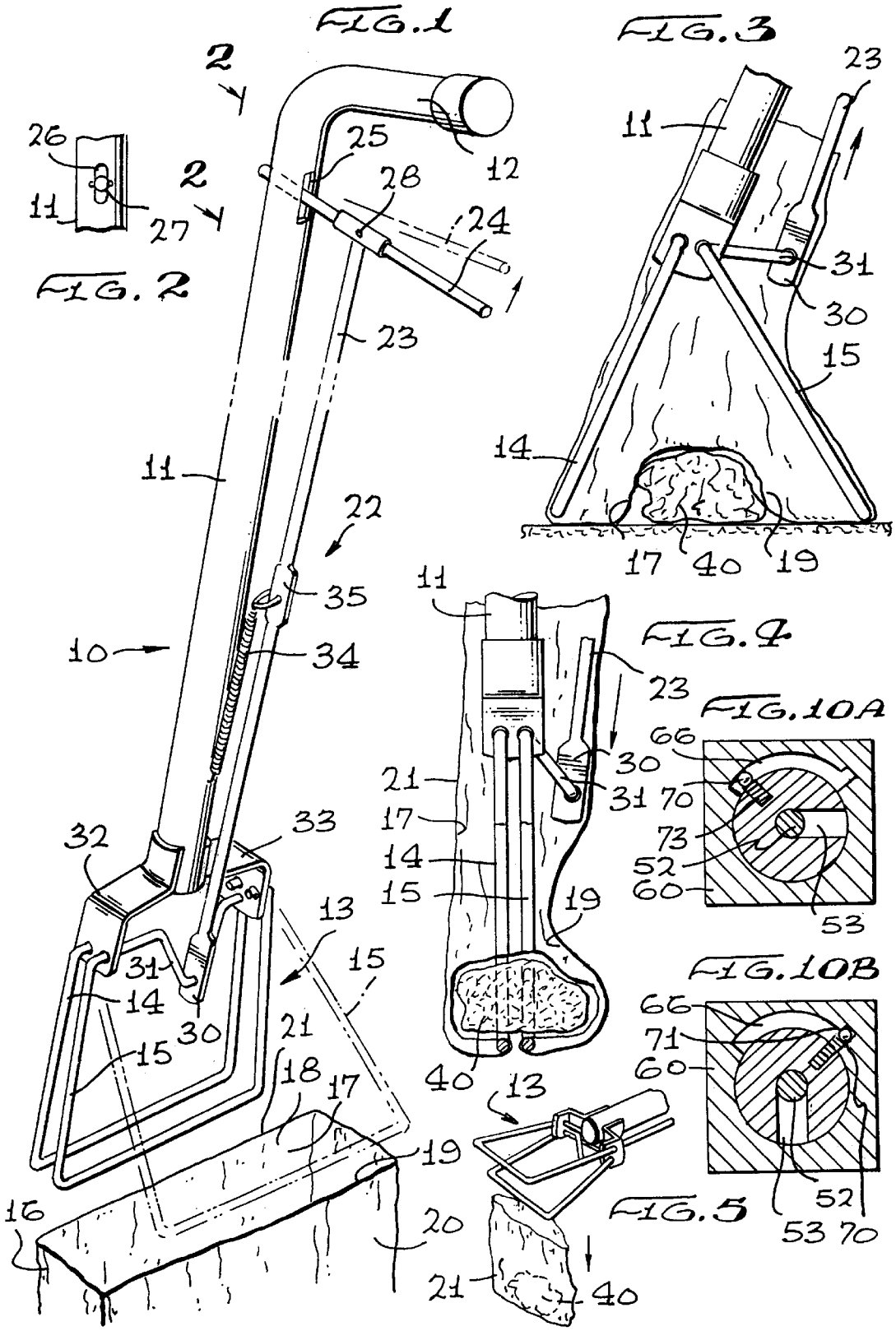
FIG. 1 is a perspective view of the novel sanitary pickup device in accordance with the present invention.
FIG. 2 is a fragmentary side elevational view of a portion of the actuating means for the single bail used in the embodiment shown in FIG. 1.
FIG. 3 is a side elevational view of the device shown in FIG. 1 with one bail illustrated as being movable with respect to a fixed or stationary bail during a collection procedure.
FIG. 4 is a view similar to the view of FIG. 3 illustrating closure of the movable bail with respect to the fixed bail for collecting droppings.
FIG. 5 is a reduced view showing the opening of the bails to release the grip on a collection bag, allowing the bag and waste material to fall free and clean.
FIGS. 10A and 10B illustrate a releasable locking device.

Referring to FIG. 1, the novel pickup device of the present invention is illustrated in the general direction of arrow 10 which includes an elongated body 11 having a handle 12 at one end which is integrally formed therewith and a pickup means at its other end, indicated in the general direction of arrow 13. The pickup means 13 includes a pair of open frame pickup members 14 and 15 adapted to collect and carry droppings within a bag 16 without touching the droppings or any other unclean material. The bag 16 is composed of a compliant, pliable and flexible material having an internal storage compartment, broadly indicated by numeral 17 which is defined between opposing inner surfaces of the bag, as represented by numerals 18 and 19, respectively. External surfaces of the bag are indicated by numerals 20 and 21 which are surfaces opposite from the inner surfaces 19 associated with external surface 20 and inner surface 18 associated with the outer surface 21.

The pickup means 13 may be manually operable from the handle end 12 of the body 11 by a control actuator means 22. This latter means includes an elongated rod 23 operable by a lever 24 between the position shown in solid lines and that shown in broken lines. One end of the lever 24 is passed through a slot 25 in the body 11 and terminates in an aperture 26, as shown in FIG. 2, so that this end of the lever can readily pivot in an up and down or vertical direction. The end of the lever is maintained in the slot 26 by means of crimps, such as crimp 27 carried on the end of the lever exteriorly of the body and slot 26. The control actuator means further includes a pivot connection 28 operably coupling one end of the rod 23 to the midsection of the lever 24. The lever 24 is in close proximity to the handle 12 so that the operator of the device can readily grasp the handle at the palm of one hand while extending the fingers about the lever 24 for up and down action. The opposite end of rod 23 from its end coupled to lever 24 includes a flat portion 30 that rotatably receives a V-shaped portion 31 having opposite ends outwardly extending to form with the bail frame 15. It is to be particularly noted that the bail frame 15 is movable and is rotatably carried within a pair of holes formed into the legs of a yoke having members 32 and 33, respectively. The legs 32 and 33 are fixedly carried on the end of the body 11 opposite from its end carrying the handle 12 and extend outwardly and downwardly to terminate in free ends in which the holes for rotatably mounting the bail frame 15 are carried. Therefore, it can be seen that as the elongated rod 23 is moved up and down in response to actuation of the lever 24, the flat section 30 movably connected to the V-shaped portion 31 will cause the bail frame 15 to move between the position shown in solid lines and the position shown in broken lines. Notably, the other bail of the pair, represented by numeral 14, is a fixed bail and is held in a stationary position by its mounting and connection to the terminating ends of the legs 32 and 33 of the yoke. The bail frame 14 is considered an extension of the body 11 and is stationary thereto lying substantially along the longitudinal central axis of the body 11. The movable bail frame 15 is slightly offset from the central longitudinal axis of the body 11 so that it may more readily move to and from the stationary bail frame 14.

The movable bail frame 15 is normally held in a position immediately adjacent the stationary bail frame 14 by means of a helical expansion spring 34 which is fixed at one end to the body 11 and fixed at its other end to a fixture 35 carried at the midsection of the elongated rod 23. Manual actuation of the lever 24 will overcome the resistance of the spring 34 so that the bail frame 15 may be moved into the broken line position.

Regarding the use of the novel sanitary pickup device of the present invention, a plastic pliable bag is placed over the closed bails as shown in FIG. 1, followed by opening of the bails and pushing the end of the bag inward between the two bails by the user's fingers. Bending the user's fingers outward to form a pocket in the bag prevents the bag from falling off the bails when making a pickup, as shown in FIG. 3. The unsanitary material is indicated by numeral 40 and can be seen in FIG. 3 preparatory for closing of the movable bail 15 towards the stationary bail 14 to effect pickup. When the bails are open and placed over the waste material 40, both bails force the bag to firmly touch the ground.

Figures 6, 7, 8, 9A, 9B:
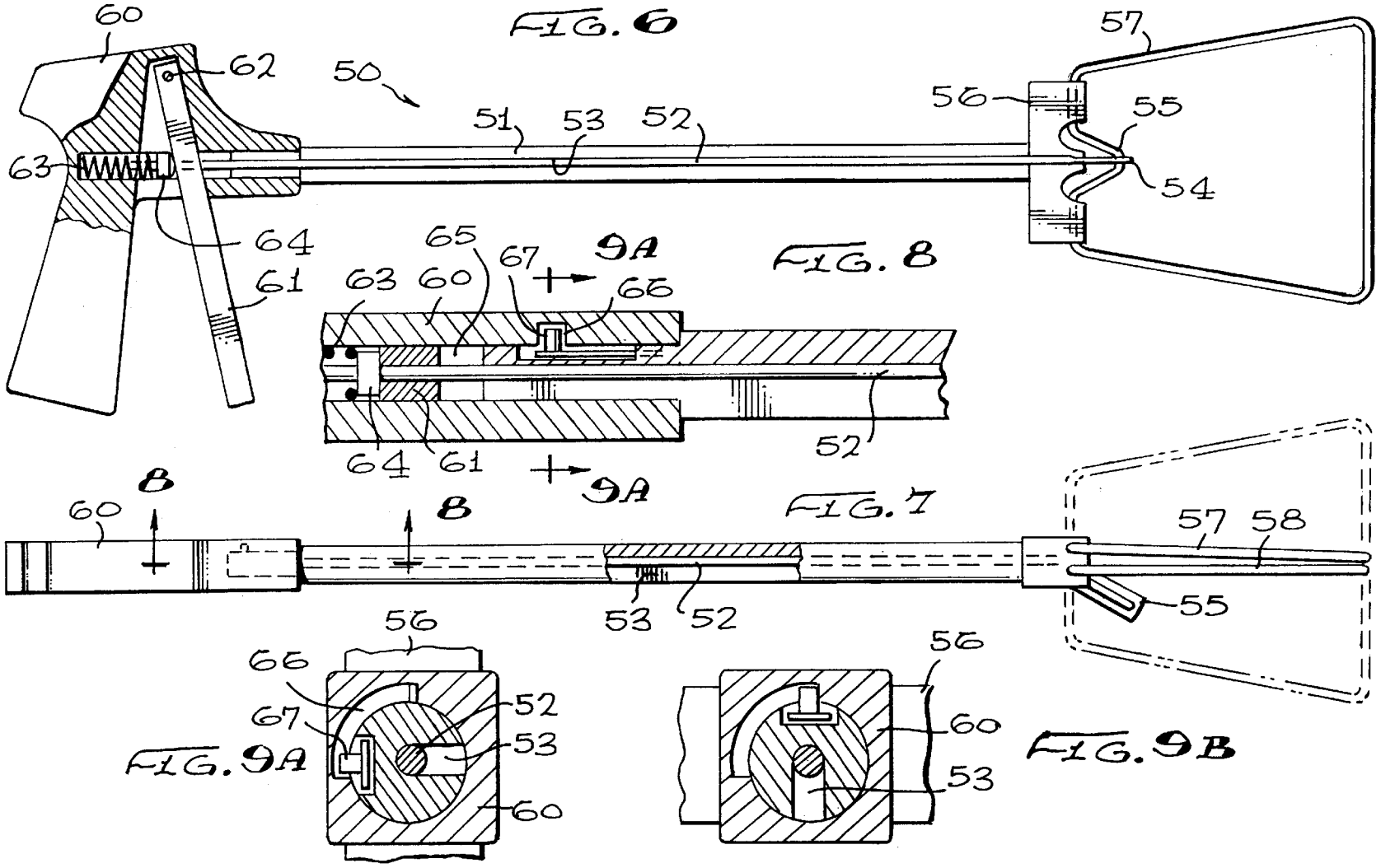
FIG. 6 is another version of the sanitary pickup device in accordance with the present invention.
FIG. 7 is a top plan view, partly in section, of the sanitary pickup device shown in FIG. 6.
FIG. 8 is an enlarged fragmentary sectional view of the mechanism operating the bails in the device shown in FIG. 6 as taken in the direction of arrows 8—8 in FIG. 7.
FIGS. 9A and 9B are transverse cross-sectional views of the device shown in the respective storage condition of the device and the operating condition of the device wherein the section is taken along lines 9A in FIG. 8.

Referring now in detail to. FIG. 4, the bails are permitted to slowly come together forcing the unsanitary waste material over the cross member of each of the bails and into a pocket or into the internal storage compartment of the bag. With the bails closed, the waste material will hang in the bag exteriorly of the bail for carrying purposes. Once transported to a disposal area, such as a trash can or the like, the bails are opened to release the grip on the bag thereby allowing the bag and the waste material to fall free and clean. Such disposal is hands-off by the operator and such disposal is indicated in FIG. 5. The waste within the bag has been released from the bail and falls by gravity into a trash container. Another version of the invention is illustrated in FIG. 6 and is indicated in the general direction of arrow 50. In this example, an elongated body 51 is employed to house a reciprocating rod 52 which is partially exposed through a slot in body 51 as represented by numeral 53. One end of the rod 52 terminates in a crank mechanism similar to the mechanism described with respect to the embodiment shown in FIG. 1. The end of the rod terminates in a crank 54 and is in pivoting connection with respect to a V-shaped member 55. The member 55 is pivotally mounted in a yoke or block 56 and forms a bail 57 which is used in cooperation with an alternate bail 58 as shown in FIG. 7. The movable bail 57 is the only bail of the pair that moves and it is understood that bail 58 is stationary and does not move as previously described with respect to the embodiment shown in FIG. 1.

The primary feature of the version shown in FIGS. 6 and 7 resides in the fact that the device has a storage position in which a handle or grip 60 has opposite flat planar surfaces which are parallel or in alignment with the bails 57 and 58 so that the entire device may be stored in a flat condition. By being in a flat condition, the device may be packaged and transported for shipment and/or storage purposes. However, when it is desired to use or operate the device, the handle or grip 60 is rotated 90 degrees so that the longitudinal axis of the handle or grip 60 is perpendicular to the longitudinal or major axis of the bails 57 and 58. The latter position is shown in FIG. 7 when the bails are in the dotted line position. However, for storage purposes the handle or grip 60 is shown in solid lines in FIGS. 6 and 7 with the bails shown in solid lines.

It is further noted that a trigger mechanism is physically carried on the handle or grip 60 and the trigger is indicated by numeral 61 with the pivot indicated by numeral 62. The handle includes a spring 63 carried in an internal cavity which is compressed between one end of the cavity and a nut 64 that is fixed on the opposite end of rod 52 from its end coupled to the crank mechanism. The trigger 61 has a hole for accommodating the rod 52 and the back side of the trigger bears against the nut 64 so that as the trigger is squeezed towards the grip, the crank mechanism is actuated. It is not intended for the trigger to be actuated when the handle or grip is in the storage position.

Referring to FIG. 8, it can be seen that the handle or grip 60 includes a cavity 65 for accommodating the pivotal movement of the trigger 61 as well as for accommodating the spring 63 and nut 64 at the end of rod 52. Furthermore, the handle or grip 60 is provided with a curved slot 66 into which a detent 67 rides in order to permit positioning of the handle or grip 60 into either its storage or operative condition. The detent 67 is carried on the end of a leaf spring so that it easily rides within the arcuate or curved slot 66.

As shown more clearly in FIGS. 9A and 9B, the detent 67 bears against the end of the slot 66 to releasably position the handle or grip 60 in either of the two conditions. As shown in FIG. 9A, the handle or grip 60 is in the position shown in FIG. 6 and is in alignment with the yoke 56 so that the device is flat and in the storage condition. It can be seen in FIG. 9A that the flat opposite surfaces of handle or grip 60 are in alignment with and do not project beyond the opposite side surfaces of the yoke 56 other than for a small thickness. On the other hand, when the handle or grip 60 has been rotated to the position shown in FIG. 9B, the opposite surfaces of the handle or grip 60 are in a non-parallel position with respect to the opposite flat surfaces of the yoke 56. Therefore, the position shown in FIG. 9B is considered the operative position or condition for the handle or grip 60.

FIGS. 10A and 10B illustrate a releasable locking arrangement having a rounded bulb or pin locked by a compression spring for holding the handle assembly in the operative position. A detent or ball 70 rides in the arcuate groove 66 between the opposite ends of the groove as the handle assembly is turned. A depression 71 receives the detent 70 as shown in FIG. 10B to releasably hold the handle assembly in the operative position. Spring 73 urges the detent into the recess or depression 71 and its expansion force is overcome manually when the handle assembly is moved back into the storage position as shown in FIG. 10A. Either the handle or body is rotated relative to each other for 90 degrees.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed:

1. In a portable pickup device for grasping and transporting unclean material such as animal droppings and the like, said device having an elongated body provided with a handle at one end:

pickup means carried at the other end of the body including a pair of cooperative pickup members arranged in virtually parallel planes in a first closed position;

one of said pair of members being a fixed, stationary downwardly depending member with the other member of said pair pivotally and movably carried on the body adjacent to said one fixed, stationary member;

said movable member movable into said closed position and alternately movable into a non-parallel open position with respect to said stationary member;

manual actuating means carried on said body and operably coupled to said movable member for moving said movable member between said open and said closed positions beneath a dropping to be picked up;

a disposable compliant wrapping means received and held on said pickup means;

said movable pickup member permitting outward lateral displacement of said compliant wrapping means when a dropping is lifted by said pickup means for containing the dropping in said wrapping means at one side of the pickup means;

said handle having a storage condition and an alternate operative condition;

said handle and said pickup members being in parallel alignment in said storage condition and said handle and pickup members being in non-parallel alignment when in said operating condition;

said handle and said pickup members' parallel alignment storage condition and non-parallel alignment operative condition are at least 90 degrees apart;

said handle is rotatably mounted on said elongated body;

means cooperatively carried between said elongated body and said handle for limiting the degree of rotation between said elongated body and said handle;

said elongated body includes a slot extending along and opening along its length for movably supporting a rod in said actuating means; and said rod having opposite ends, one of which is coupled to said movable member and the other of which is movably supported on said handle.

2. The pickup device defined in claim 1 wherein:

said actuating means includes a pistol grip member and a trigger pivotally mounted on said pistol grip member.

3. In a portable pickup device comprising:

an elongated body having opposite ends, one end of which rotatably supports a handle and the other end of which is affixed to a yoke;

a pair of bails carried on said yoke with one bail of said pair being immobile and fixed and with the other bail of said pair being movable away from and towards said immobile and fixed bail;

said handle having two positions, one position of which is in said parallel alignment with said pair of bails and constitutes a storage position and the other an operative position of said handle being normal to said pair of bails;

stop means interposed between said handle and said body for limiting the extent of handle rotation on said body;

actuation means carried between said handle and said bails and extending along said body for selectively moving said movable bail with respect to said fixed bail;

said actuation means includes a pistol grip and a trigger pivotally carried on said handle operatable to move towards said pistol grip to move said movable bail;

a spring disposed between said handle and said trigger yieldably urging said trigger away from said pistol grip; and said stop means includes an arcuate groove having opposite ends in said handle and a resilient detent carried on said body wherein said detent travels within said groove between said opposite ends to determine said storage position and said operative position.

4. The pickup device defined in claim 3 including:

a releasable locking means disposed between said body and said handle having a rounded detent backed by a compression spring.

* * * * *